US007725057B2

(12) United States Patent
Nagai

(10) Patent No.: US 7,725,057 B2
(45) Date of Patent: May 25, 2010

(54) IMAGE FORMING METHOD AND IMAGE FORMING APPARATUS

(75) Inventor: Takashi Nagai, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 653 days.

(21) Appl. No.: 11/727,671

(22) Filed: Mar. 28, 2007

(65) Prior Publication Data

US 2007/0231019 A1 Oct. 4, 2007

(30) Foreign Application Priority Data

Mar. 29, 2006 (JP) ..... 2006-091670

(51) Int. Cl.
*G03G 15/08* (2006.01)
*G03G 15/09* (2006.01)
*G03G 13/09* (2006.01)

(52) U.S. Cl. ..... 399/252; 399/276; 430/120.1

(58) Field of Classification Search ..... 399/252, 399/276; 430/120.1, 105, 111.4, 110.3
See application file for complete search history.

(56) References Cited

U.S. PATENT DOCUMENTS 5,712,073 A * 1/1998 Katada et al. ..... 430/110.3
6,760,560 B2 * 7/2004 Nagai et al. ..... 399/252
7,090,956 B2 * 8/2006 Suzuki et al. ..... 430/110.3
7,418,227 B2 * 8/2008 Omata
2004/0038142 A1 * 2/2004 Yoshida et al. ..... 399/252
2005/0026065 A1 * 2/2005 Onuma et al. ..... 430/110.3
2006/0093947 A1 * 5/2006 Imafuku et al.

FOREIGN PATENT DOCUMENTS

JP 3372698 11/2002
JP 3382483 12/2002

* cited by examiner

*Primary Examiner*—Susan S Lee
(74) *Attorney, Agent, or Firm*—Clark & Brody

(57) ABSTRACT

Disclosed is an image forming method, containing a development step of developing an electrostatic latent image formed on an electrostatic image supporting material using a toner formed on a development sleeve in the from of a thin layer to form a toner image, wherein a ten-point average roughness Rz on the surface of the development sleeve is from 3.0 to 5.7 μm, a volume average particle size of toner particles is from 6.0 to 8.0 μm, the content of a volume average particle size of the toner particles of 5.0 μm or less is from 2.2 to 11.0% by volume, a shape coefficient SF-1 of the toner particles that is measured by an image-analyzing apparatus satisfies the relation: 115≦SF-1≦155, and a shape coefficient SF-2 of the toner particles that is measured by an image-analyzing apparatus satisfies the relation: 112≦SF-2≦150.

7 Claims, 1 Drawing Sheet

IMAGE FORMING METHOD AND IMAGE FORMING APPARATUS

Priority is claimed to Japanese Patent Application No. 2006-091670 filed on Mar. 29, 2006, the disclosure of which is incorporated by reference in its entirety.

BACKGROUND OF THE INVENTION

1. Field of the Invention

The present invention relates to an image forming method utilized in the field of copy machines, printers, and facsimiles using electric photographs and an electrostatic recording system.

2. Description of Related Art

Conventionally, in electrophotography, the surface of an electrostatic image supporting material (hereinafter, also referred to as a photoreceptor) is uniformly charged and an electrostatic image is formed by exposure to light under a predetermined manuscript information, and a toner is flied on the electrostatic image and thereby a toner image is formed. Then, the toner image is transferred onto a predetermined form, and by heating and pressurizing with a fixing roller, the toner image is fixed and thereby, the image is formed.

The toner used in electrophotography has been obtained by, mixing at least a colorant-containing-thing in a binder resin, then melting-kneading by two-shaft kneading machine and so forth and cooling, and then going through a grinding process and a classification operation, and then adding and mixing an inorganic oxide and so forth therein.

In the grinding process, a shape of the toner to be produced is different by a factor such as a kind of the grinding equipment and so forth. And, it is known that the shape affects the cleaning property or the transfer property. Accordingly, there has been proposed a method that the shape of the toner is set to be in a prescribed range and thereby the cleaning performance and the transferring performance are improved (see, for example, Japanese Patent No. 3,372,698).

On the other hand, in a two-component development system, in order to enhance the transferring performance, it has been investigated to obtain a high-quality and high-definition image by determining density of a magnetic brush formed on a development sleeve and so forth. For example, there has been proposed a method that the magnetic brush of a two-component toner on a development sleeve is contacted with a photoreceptor, and a development bias containing bias for removing fog is applied thereto and the electrostatic latent image on the photoreceptor is developed, and therewith, the post-transfer residual toner on the photoreceptor is removed (see, for example, Japanese Patent No. 3,382,483).

However, as shown in the Japanese Patent No. 3,372,698, when the shape of the toner is merely restricted and set to be small-sized, the content of the toner of 5 μm or less is prone to increase and the liquidity of the toner is prone to lower. Therefore, degradation of the agitation and carrier property in the development equipment or lowering of the toner amount carried on the development sleeve is caused, and concentration failure or fog in an overlaid part is caused, and therefore, it becomes difficult to obtain an image having uniformity in gray or dot reproducibility and quality of the image becomes degraded. Moreover, if the post-transfer residual toner can be removed as described in Japanese Patent No. 3,372,698, a larger toner amount becomes required for obtaining a predetermined image concentration and thereby, the wasted toner such as the post-transfer residual toner becomes larger, and also this is not preferable environmentally.

SUMMARY OF THE INVENTION

The advantage of the present invention is to provide an image forming method in which even if the used toner amount is small, a sufficient image concentration is ensured and also reproducibility of the dot image is high.

An image forming method according to the present invention contains at least a development step of developing an electrostatic latent image formed on an electrostatic image supporting material using a toner formed on a development sleeve in the form of a thin layer to form a toner image, wherein a ten-point average roughness Rz on the surface of the development sleeve is from 3.0 to 5.7 μm, a volume average particle size of toner particles is from 6.0 to 8.0 μm, the content of the toner particles having a volume average particle size of 5.0 μm or less is from 2.2 to 11.0% by volume, a shape coefficient SF-1 of the toner particles that is measured by an image-analyzing apparatus and represented by a following formula (1) satisfies the relation: 115≦SF-1≦155, and a shape coefficient SF-2 of the toner particles that is measured by an image-analyzing apparatus and represented by a following formula (2) satisfies the relation: 112≦SF-2≦150:

$$SF\text{-}1=\{(\mathrm{MXLNG})^2/\mathrm{AREA}\}\times(\pi/4)\times 100 \quad (1)$$

$$SF\text{-}2=\{(\mathrm{PERI})^2/\mathrm{AREA}\}\times(1/4\pi)\times 100 \quad (2)$$

where MXLNG denotes an absolute maximum length of the particle, PERI denotes a peripheral length of the particle, and AREA denotes a projected area of the particle.

Moreover, a toner density of the toner thin layer formed on the surface of the development sleeve is preferably from 0.62 to 0.82 mg/cm$^2$. Furthermore, the development sleeve is preferably made of SUS (stainless steel).

An image forming apparatus according to the present invention comprises charge device for charging the surface of an electrostatic image supporting material, exposure device for exposing the charged surface of an electrostatic image supporting material to form an electrostatic latent image, development device for developing the electrostatic latent image by a toner formed with a thin layer on a development sleeve to form a toner image on the electrostatic latent image, and transfer device for transferring the toner image formed onto the electrostatic image supporting material, into a transfer member, wherein a ten-point average roughness Rz on the surface of the development sleeve is from 3.0 to 5.7 μm, and a volume average particle size of toner particles is from 6.0 to 8.0 μm, the content of a volume average particle size of the toner particles of 5.0 μm or less is from 2.2 to 11.0% by volume, a shape coefficient SF-1 of the toner particles that is measured by an image-analyzing apparatus and represented by the above described formula (1) satisfies the relation: 115≦SF-1≦155, and a shape coefficient SF-2 of the toner particles that is measured by an image-analyzing apparatus and represented by the above described formula (2) satisfies the relation: 112≦SF-2≦150.

According to the present invention, by using toner particles having small diameters, their shape is restricted and the content of the toner particles having an average particle size of 5 μm or less is optimized and the surface roughness of the development sleeve is set to be in a predetermined range, and those are combined and used and therefore, a toner thin layer that is uniform and has a high toner density can be formed, and as a result, even if the used toner amount is smaller, high-quality image can be obtained.

DESCRIPTION OF PREFERRED EMBODIMENTS

Figure 1:
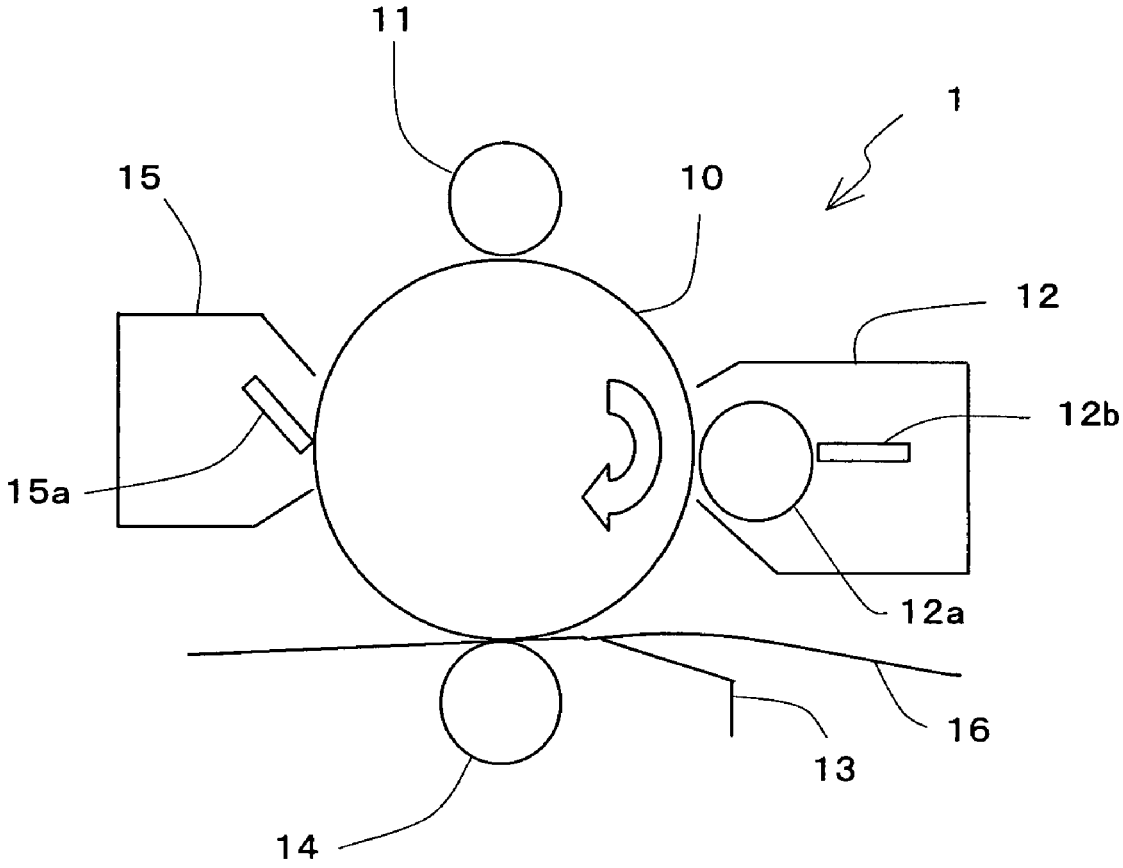
FIG. 1 is a schematic view showing an image forming apparatus according to an embodiment of the present invention.

An image forming apparatus according to the present invention is shown in FIG. 1. As shown in FIG. 1, an image forming method according to the present invention is a jumping development system of magnetic one-component that a rotatable development sleeve 12*a* is disposed oppositely to a electrostatic image supporting material 10 and a toner is carried by rotation of the development sleeve 12*a* and passed between a restricting blade 12*b* and the development sleeve 12*a* and thereby, a toner thin layer is formed on the surface of the development sleeve 12*a* and an electrostatic latent image on the electrostatic image supporting material 10 is developed. A volume average particle size of the used toner particles is from 6.0 to 8.0 μm. The content of the toner particles having a volume average particle size of 5.0 μm or less is from 2.2 to 11.0% by volume. A shape coefficient SF-1 of the toner particles that is measured by an image-analyzing apparatus satisfies the relation: 115≦SF-1≦155. A shape coefficient SF-2 of the toner particles satisfies the relation: 112≦SF-2≦150. A ten-point average roughness Rz on the surface of the development sleeve 12*a* is from 3.0 to 5.7 μm.

That is, in the present invention, the volume average particle size of the toner particles, the content of the toner particles having a volume average particle size of 5.0 μm or less, the shape coefficients of the toner particles, and the ten-point average roughness Rz on the surface of the development sleeve 12*a*, are combined and used under the above-described ranges and thereby, the toner thin layer that is uniform and has a high toner density can be formed on the surface of the development sleeve 12*a*. And, with a small amount of the used toner, a high-quality and favorable image can be obtained.

Here, the volume average particle size of the toner particles means a particle size ($D_{50v}$) when the volume accumulated from its small diameter side becomes 50%, and, for example, can be measured by a measurement apparatus such as Coulter Counter TA-II (manufactured by Beckman coulter Inc.) or Multisizer II (manufactured by Beckman coulter Inc.).

The toner particles of the present invention has a volume average particle size of 6.0 to 8.0 μm, preferably 6.2 to 7.8 μm. If the volume average particle size is less than 6.0 μm, the dust-size particle toner amount becomes large, and the overcharged toners are agglomerated and image fog is caused. Moreover, if more than 8.0 μm, a high-quality image becomes difficult to be obtained and, degradation of the image concentration is caused as the formation of image is repeated. Moreover, with respect to the toner particles of the present invention, the content of the toner particles having a volume average particle size of 5.0 μm or less (dust-size particle) is from 2.2 to 11.0% by volume, and preferably from 2.5 to 10.0% by volume. If the dust-size amount of the toner particles is more than 11.0% by volume, charge amount distribution in the toner becomes broad and, not only image failure such as fog is caused but also cleaning failure is triggered in the photoreceptor 10 and, long-term durability performance becomes lost. In particular, it is thought that disturbance is caused in the toner thin layer due to defect charge and therefore, the toner thin layer cannot be stably supplied for a long term.

Moreover, with respect to the toner particles of the present invention, as described above, a shape coefficient SF-1 of the toner particles satisfies the relation: 115≦SF-1≦155, preferably 115≦SF-1≦150. A shape coefficient SF-2 of the toner particles satisfies the relation: 112≦SF-2≦150, preferably 112≦SF-2≦145. The shape coefficient SF-1 represents roundness degree of the toner particles, and the shape coefficient SF-2 represents irregularity degree of the toner particles. It is thought that when shape coefficients are in the range, both of high transfer property and high cleaning property can be satisfied.

Here, in the present specification, with respect to SF-1 and SF-2 that represent shape coefficients, for example, 100 images of the magnetic particles having 10 μm or less, which are magnified at 1000 times by using FE-SEM (S-800) manufactured by Hitachi, Ltd., are randomly sampled, and through an interface, the image information is introduced and analyzed in the image-analyzing apparatus (Lezex III)manufactured by Nicolet Inc. and calculated by the above-described formulas (1) and (2), and thereby the obtained values are defined as SF-1 and SF-2.

In addition, the shape coefficients can be controlled by changing the rotation speed of grinding in a grinding process, the grinding time, and so forth, in production of the toner particles by a grinding method.

(Toner)

The toner of the present invention is not specifically limited, and any one of magnetic one-component toner and non-magnetic two-component toner may be used.

The toner particles of the present invention can be obtained by, for example, dispersing various toner compounding agents such as colorant in a binder resin by a grinding method.

That is, the toner used in the present invention can be obtained by adding, in a predetermined amount of binder resin, a predetermined amount of a colorant and, additive such as wax or charge inhibiting agent according to need, then stirring and mixing them by a mixing apparatus such as Henschel mixer. The mixture obtained by mixing with stirring is melted and kneaded by a twin screw extruder and so forth and cooled and then, ground by a grinding apparatus such as a hammer mill or a jet mill. Next, classification is performed by a classification apparatus such as a wind force classification apparatus and then, the toner particles having a particle size of a predetermined size and predetermined shape coefficients can be obtained. It is preferable that the sizes of the above-described toner particles are controlled to be approximately from 6 to 8 μm.

Moreover, for obtaining the toner particles, a polymerization method can also be used. In the polymerization method, mainly, a suspension polymerization method or an emulsion polymerization method is used. In the polymerization method, to the binder resin, wax and colorant are added and, further a charge control agent, a polymerization initiating agent, and/or a crosslinking agent are/is added according to need, and the mixture or the dispersion liquid that is the binder resin to which the additives are added is particle-formed and polymerized with being stirred in an aqueous phase, and thereby, the toner particles having desired sizes can be obtained.

(Binder Resin)

The kind of the binder resin used in the toner in the present invention is not particularly limited. However, it is preferable to use a thermoplastic resin such as styrene-based resin, acryl-based resin, styrene-acryl-based copolymer, polyethylene-based resin, polypropylene-based resin, vinylchloride-based resin, polyester-based resin, polyamide-based resin, polyurethane-based resin, polyvinyl alcohol-based resin, vinylether-based resin, N-vinyl-based resin, and styrene-butadiene resin.

More specifically, the polystyrene-based resin may be homopolymer of styrene or copolymer of styrene and another copolymerization monomer that can be copolymerized with styrene. The copolymerization monomer includes p-chlorstyrene; vinylnaphthalene; ethylene-unsaturated mono-olefin such as ethylene, propylene, butylene, and isobutylene; vinyl halide such as vinyl chloride, vinyl bromide, and vinyl fluoride; vinyl ester such as vinyl acetate, vinyl propionate, and vinyl butyrate; (meta) acrylic ester such as methyl acrylate, ethyl acrylate, n-butyl acrylate, isobutyl acrylate, dodecyl acrylate, n-octyl acrylate, 2-chlorethyl acrylate, phenyl acrylate, methyl α-chloracrylate, methyl methacrylate, ethyl methacrylate, and butyl methacrylate; other acrylic derivatives such as acrylonitrile, methacrylonitrile, acrylamide; vinylether such as vinyl methyl ether, vinyl isobutyl ether; vinyl ketone such as vinyl methyl ketone, vinyl ethyl ketone, and methyl isopropenyl ketone; and N-vinyl compound such as N-vinylpyrrole, N-vinylcarbazole, N-vinylindole, N-vinyl pyrrolidone. One kind of those can be used singularly, or two kinds or more of those can be combined and copolymerized with styrene monomer.

It is preferable that the polystyrene-based resin has two peaks of mass average molecular weight (referred to as low molecular weight peak and high molecular weight peak) in the binder resin. Specifically, it is preferable that the low molecular weight peak is in the range from 3,000 to 20,000 and the other high molecular weight peak is in the range from 300,000 to 1,500,000 and Mw/Mn is 10 or more. When, the peaks of mass average molecular weight are in such ranges, toner can be easily fixed and also offset resistance can be improved. In addition, the mass average molecular weight in the binder resin can be obtained by measuring the time of elusion from the column using a molecular weight-measuring apparatus (GPC) and then comparing its result with an analytical curve that is preliminarily created by using a reference polystyrene resin.

Moreover, the polyester-based resin can be used as long as being capable of being obtained by condensation polymerization or copolymerization of an alcohol component and a carboxylic acid component. The component used in synthesizing the polyester-based resin includes the following components. First, the dihydric, or trihydric or polyhydric alcohol components include, for example, diol such as, ethylene glycol, diethylene glycol, triethylene glycol, 1,2-propylene glycol, 1,3-propylene glycol, 1,4-butane diol, neopentyle glycol, 1,4-butanediol, 1,5-pentanediol, 1,6-hexanediol, 1,4-cyclohexane dimethanol, dipropylene glycol, polyethylene glycol, polypropylene glycol, and polytetramethylene glycol; bisphenol such as bisphenol A, hydrogenized bisphenol A, polyoxyethylated bisphenol A, polyoxypropylated bisphenol A; trihydric or polyhydric alcohol such as sorbitol, 1,2,3,6-hexanetetorol, 1,4-sorbitane, pentaerythritol, dipentaerythrol, tripentaerythrol, 1,2,4-butane triol, 1,2,5-pentanetriol, glycerol, diglycerol, 2-methylpropanetriol, 2-methyl-1,2,4-butanetriol, trimethyrolethane, trimethyrolpropane, 1,3,5-trihydroxymethylbenzene Moreover, as the dihydric, or trihydric or polyhydric carbonic acid components, the dihydric or trihydric carbonic acid and its acid anhydride or its lower alkyl ester is used. The compounds includes dihydric carbonic acids such as maleic acid, fumaric acid, citraconic acid, itaconic acid, glutaconic acid, phthalic acid, isophthalic acid, telephthalic acid, cyclohexanedicarboxylic acid, succinic acid, adipic acid, sebacic acid, azelaic acid, malonic acid, or n-butylsuccinic acid, n-butenylsuccinic acid, isobutylsuccinic acid, isobutenylsuccinic acid, n-octylsuccinic acid, n-octenylsccinic acid, n-dodecylsuccinic acid, n-dodecenylsuccinic acid, isodecylsuccinic acid, and isododecenylsuccinic acid; and trihydric or polyhydric carbonic acid such as 1,2,4-benzene tricarbonic acid (trimellitic acid), 1,2,5-benzene tricarbonic acid, 2,5,7-naphthalene tricarbonic acid, 1,2,4-naphthalene tricarbonic acid, 1,2,4-butane tricarbonic acid, 1,2,5-hexane tricarbonic acid, 1,3-dicarboxyl-2-methyl-2-methylene carboxy propane, 1,2,4-cyclohexane tricarboxyl acid, tetra(methylene carboxyl)methane, 1,2,7,8,-octanetetracarboxyl acid, pyromellitic acid, and enpole trimer.

Moreover, it is preferable that the softening point of the polyester-based resin is from 110 to 150° C., and more preferably from 120 to 140° C.

Moreover, it is preferable that the binder resin is a thermoplastic resin in an aspect of favorable fixability. However, if the amount of cross linking part (gel amount) that is measured by using Soxhlet extraction equipment is 10 mass % or less, more preferably, a value in the range from 0.1 to 10 mass %, heat curing resin is also possible. By introducing cross linking structure partially as described above, storing stability of the toner, shape holding property thereof, durability thereof can be more improved without degrading the fixability. Therefore, as the binder resin of the toner, 100 mass % of thermoplastic resin is not required to be used. It is also preferable that a crosslinking agent is added or heat curing resin is partially used.

Accordingly, as the heat curing resin, epoxy-based resin, or cyanate-based resin and so forth can be used. Specifically, the resin includes one kind of bisphenol A-type epoxy resin, hydrogenated bisphenol A-type epoxy resin, novolac type epoxy resin, polyalkylene ether type epoxy resin, cyclic aliphatic type epoxy resin, cyanate resin, and so forth, or a combination of two or more kinds of those.

In addition, the softening point is obtained by a ½ method for obtaining the temperature when the ½ amount of the sample is eluted under the condition of sample amount: 1.8 g, die-hole diameter: 1 mm, die length: 1 mm, extruding pressure: 4 MPa.

In the functional groups in the binder resin, in order to improve dispersibility of the magnetic powders in such a binder resin, it is preferable to use resin having, in the molecule, at lest one functional group selected from hydroxyl group, carboxyl group, amino group and glycidoxy (epoxy). In addition, whether the resin has such functional groups or not can be confirmed by using FT-IR apparatus, and the groups can be quantitatively determined by a titrating method.

It is preferable that in the binder resin, the glass transition point (Tg) is set in the range of 55~77° C. If the glass transition point of the binder resin is less than 55° C., the obtained toner are fused to each other and maintenance stability is prone to be degraded. On the other hand, if the glass transition point of the binder resin is more than 70° C., fixibility of the toner is prone to becomes poor.

In addition, the described Tg is obtained by the following measurement method. Specially, as the apparatus for measuring Tg, DSC62000 manufactured by a SSI Technology Inc is used and first approximately 10 mg of the sample is put in a sample container made of aluminum and the sample is put on the holder unit and set in an electric furnace. Then, after the sample was heated from 30° C. to 170° C. at a temperature-rising rate of 10° C./min and then the sample was cooled to 30° C. and the DSC measurement was performed by heating to 170° C. at a rising rate of 10° C./min again.

Tg can be calculated from the intersection of tangent of the endothermic curve in the vicinity of Tg and the base line and obtained.

(Magnetic Powder)

In the case that the developing powder is used as the magnetic toner, magnetic powder is used as the toner. Moreover, in this case, the magnetic powder functions as a colorant. The magnetic powder includes known ones such as metal or alloy showing ferromagnetism such as iron like ferrite, magnetite, cobalt, nickel and so forth or compound containing these chemical elements, or alloy coming to show ferromagnetism by being subjected to an appropriate heat treatment in spite of not containing a ferromagnetic element, or chromium dioxide.

These magnetic powders are dispersed uniformly in the above-described binder resin in a fine particle form having an average particle diameter that is in the range from 0.1 to 1 μm, and particularly preferably from 0.1 to 0.5 μm. Moreover, the magnetic powder can be used after subjected to surface treatment with a surface treating agent such as titanium coupling agent and silane coupling agent. The average particle diameter of the magnetic powders is an average of marching diameters (corresponding to circular diameters) of 300 magnetic powders showed in a photograph that is magnified at 4 times of the photograph taken by a scanning electron microscope (×10,000).

Moreover, it is preferable that the magnetic powders are contained at an amount in a range from 30 to 60 parts by mass, and particularly preferably from 45 to 55 parts by mass. If a larger amount of the magnetic powder than the above-described range is used, the durability of the image density becomes degraded, and the fixability is prone to extremely lower. If the smaller amount than the above-described range, fog in the image density durability becomes degraded.

The shape of the magnetic powders used in the present invention is not particularly prescribed. However, when the shape of the contained magnetic powder is not a ball shape but a polyhedron having edges (such as hexahedron, octahedron), it can be expected that one corner or a plurality of corners of the magnetic powders is/are exposed. Furthermore, when the content of the magnetic powder is in the range from 40 to 55 mass %, there can be obtained an effect that the charge in the residual toner is gradually discharged from the edge of the magnetic powders before the electric potential of the toner remaining in the edge of the cleaning blade 15*a* reaches to the dielectric breakdown potential of photorecepter by frictional electrification with the blade.

In the observation of the shape of the magnetic powder, according to need, transmission electron microscope (TEM) H-700H, H-800, H-7500 (all manufactured by HITACHI Co., Ltd.), or scanning electron microscope (SEM) S-800 or S-4700(both manufactured by HITACHI Co., Ltd.) are used and photographed at 20000 to 200000 times. Baking magnification is set to 1 to 10 time(s), and the sample can be observed with a discretionary magnification.

(Charge Control Agent)

The charge control agent is distributed for significantly improving the charge level or the characteristic of boosting charge (index for charging the constant charge level in a short time) and obtaining the characteristic that is excellent in durability or stability. That is, in the case that the toner is positively charged and developed, the charge control agent having positive charge property is added. In the case that negatively charged and developed, the charge control agent having negative charge property can be added.

The charge-controlling agent is not particularly limited. However, for example, the charge-controlling agent of the positive charge property specifically includes, azine compound such as pyridazine, pyrimidine, pyrazine, olthoyxazine, metaoxazine, paraoxazine, olthothiazin, metathiazin, parathiazin, 1,2,3-triazine, 1,2,4-triazine, 1,3,5-triazine 1,2,4-oxathiazine, 1,3,4-oxathiazine, 1,2,6-oxathiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, quinoxaline; direct dye made of a azine compound such as azine fast red FC, azine fast red 12BK, azine violet BO, azine brown3G, azine light brownGR, azine dark greenBH/C, azine deep black EW, and azine deep black 3RL; nigrosin compound such as nigrosin salt and nigrosin derivative; acidic dye made of nigrosine compound such as nigrosin BK, nigrosin NB, nigrosin Z; metal salt of naphthenic acid or higher fatty acid; alkoxyl amine; alkylamide; quaternary ammonium salt such as benzylmethylhexyldecyle ammonium, decyletrimethyl ammonium chloride One kind of those can be used singularly, or two kinds or more of those can be combined and used. Particularly, nigrosin compound is most suitable for being used as the positive charged toner from the aspect of more rapidly boosting property.

Also, a resin or oligomer having a quaternary ammonium salt, a carboxylate or a carboxyl group as a functional group can be used as a positively charged charge control agent. More specific examples thereof include a styrenic resin having a quaternary ammonium salt, an acrylic resin having a quaternary ammonium salt, a styrene-acrylic resin having a quaternary ammonium salt, a polyester-based resin having a quaternary ammonium salt, a styrenic resin having a carboxylate, an acrylic resin having a carboxylate, a styrene-acrylic resin having a carboxylate, a polyester-based resin having a carboxylate, a polystyrenic resin having a carboxyl group, an acrylic resin having a carboxyl group, a styrene-acrylic resin having a carboxyl group, and a polyester-based resin having a carboxyl group, and a mixture thereof Particularly, a styrene-acrylic copolymer resin having a quaternary ammonium salt is most preferred because the charge amount can be easily adjusted within a desired range. In this case, examples of the acrylic comonomer to be copolymerized with the styrene unit include alkyl (meth)acrylate esters such as methyl acrylate, ethyl acrylate, n-propyl acrylate, iso-propyl acrylate, n-butyl acrylate, iso-butyl acrylate, 2-ethylhexyl acrylate, methyl methacrylate, ethyl methacrylate, n-butyl methacrylate, and iso-butyl methacrylate. As the quaternary ammonium salt, a unit derived from a dialkylaminoalkyl (meth)acrylate through the quaternization process is used. As the dialkylaminoalkyl (meth)acrylate to be derived, for example, di(lower alkyl)amino (meth)acrylate such as dimethylaminoethyl (meth)acrylate, diethylaminoethyl (meth)acrylate, dipropylaminoethyl (meth)acrylate or dibutylaminoethyl (meth)acrylate; and dimethylmethacrylamide or dimethylaminopropylmethacrylamide are preferable. Also it is possible to use in combination with a hydroxy group-containing polymerizable monomer such as hydroxyethyl (meth)acrylate, hydroxypropyl (meth)acrylate, 2-hydroxybutyl (meth)acrylate or N-methylol(meth)acrylamide upon polymerization.

As the charge control agent which exhibits negative charging properties, an organometal complex, for example, a chelate compound is effective, and examples thereof include aluminum acetylacetonate, iron (II)actylacetonate and chromium 3,5-di-tert-butylsalicylate. An acetyl acetone metal complex, a salicylic acid-based metal complex or a salt thereof is preferable, and a salicylic acid-based metal complex or a salicylic acid-based metal salt is particularly preferable.

The amount of the positively or negatively charged charge control agent is usually from 1.5 to 15 parts by mass, preferably from 2.0 to 8.0 parts by mass, and most preferably from 3.0 to 7.0 parts by mass, based on the toner (that is, the total amount of the toner is 100 parts by mass). When the amount of the charge control agent is less than the above range, it may become difficult to stably charge the toner to a predetermined polarity and, when images are formed by developing static latent images using the toner, the image density may decrease and durability of the image density may deteriorate. Also, poor dispersion of the charge control agent is likely to occur, and thus causing fog or severe contamination of the photoreceptor. On the other hand, the amount of the charge control agent is more than the above range, environmental resistance, poor charge under high temperature and high humidity and poor image occur, and thus defects such as contamination of the photoreceptor is likely to occur.

(Releasant)

Waxes are used as the relesant. The releasant is not specifically limited and, for example, it is preferred to use polyethylene wax, polypropylene wax, Teflon® wax, Fisher-Tropsch wax, paraffin wax, ester wax, montan wax, rice wax and the like. These waxes may be used in combination. By adding these waxes, offset resistance and image smearing can be improved.

Above-mentioned waxes are not specifically limited and the amount of waxes to be added is preferably in a range from 1 to 5 parts by mass based on the toner (the total amount of the toner is 100 parts by mass). In the case where the amount of waxes is less than 1 part by mass, offset resistance and image smearing may not be improved efficiently, while in the case where it exceeds 5 parts by mass, toners may be fused with each other, resulting in poor storage stability.

(External Addition Agent)

Silica is preferably used as an external addition agent in the present invention, and examples thereof include inorganic fine powders such as powders of titanium oxide, alumina, zinc oxide, magnesium oxide and calcium carbonate; organic fine powders such as powders of polymethyl methacrylate; and metal salts of fatty acid such as zinc stearate. These external addition agents can be used alone or in combination. Examples of the silica powder include AEROSIL RA200H, NAY200, NA50H, R972, R974, 90, SILICA D-17, T-805, R-812, RA200 and HRX-C which are manufactured by JAPAN AEROSIL CO.; TG820F, TG824F, Cab-o-SilM-5, MS-7, MS-75, HS-5, EH-5, S-17 and TS-74 which are manufactured by Cabot Co.; and KE-E30 and KE-E40, manufactured by NIPPON SHOKUBAI CO., LTD.

The amount of the external addition agent to be added is preferably in a range from 0.1 to 5.0% by mass based on the entire toner. The mixture of the external addition agent and toner particles can be conducted by using, for example, a Henschel mixer, a V-type mixer, a Tarbra mixer or a hybridizer.

The surface of the inorganic fine particles may be optionally treated with a silane coupling agent, aminosilane, silicone oil or a titanate coupling agent so as to hydrophobize the powder or control charge characteristics.

The amount of these surface treatment agents to be used is preferably in a range from 0.05 to 20 parts by weight based on 100 parts by weight of the inorganic fine particles.

Examples of the silane coupling agent include organoalkoxysilane (for example, methoxytrimethylsilane, dimethoxydimethylsilane, trimethoxymethylsilane and ethoxytrimethylsilane); organochlorosilane (for example, trichloromethylsilane, dichlorodimethylsilane, chlorotrimethylsilane, trichloroethylsilane, dichlorodiethylsilane, chlorotriethylsilane and trichlorophenylsilane); organosilazane (for example, triethylsilazane, tripropylsilazane and triphenylsilazane); organodisilazane (for example, hexamethyldisilazane, hexaethyldisilazane and hexaphenyldisilazane); and other organosilazane. These silane coupling agents can be used alone or in combination. Among these silane coupling agents, organochlorosilane, organosilazane and organodisilazane are preferably used.

Examples of preferable aminosilane include N-2(aminoethyl)3-aminopropylmethyldimethoxysilane, N-2(aminoethyl) 3-aminopropyltrimethoxysilane, N-2(aminoethyl)3-aminopropyltriethoxysilane 3-aminopropyltrimethoxysilane, 3-aminopropyltriethoxysilane, and N-phenyl-3-aminopropyltrimethoxysilane. Among these aminosilanes, 3-aminopropyltrimethoxysilane is preferably used.

Examples of the silicone oil include dimethyl silicone oil, methylphenyl silicone oil, methylhydrogen silicone oil, fluorosilicone oil and modified silicone oil. These oils can be used alone or in combination. If necessary, the silicone oil could be hardened by a crosslinking agent or a heat treatment. Among these silicone oils, dimethyl silicone oil is preferably used. Examples of the titanate coupling agent include isopropyltriisostearoyl titanate, isopropyltrichromylphenyl titanate and tetraisopropylbis(dioctylphosphite)titanate. These titanate coupling agents could be used alone or in combination. Among these titanate coupling agents, isopropyltriisostearoyl titanate is preferably used.

(Image Forming Apparatus)

The image forming apparatus according to one embodiment of the present invention will be described with reference to drawings. FIG. 1 is a view showing a schematic structure of the image forming apparatus according to the present invention. The image forming apparatus 1 according to one embodiment of the present invention comprises a electrostatic image supporting material drum 10 using an amorphous silicon drum, a charging roller 11 that is a contact charging member for having contact with the surface of the electrostatic image supporting material 10 and applying a charge voltage thereto, exposure means (not shown) for exposing the surface of the electrostatic image supporting material 10 and forming an electrostatic latent image, a development means 12 such as a development sleeve 12*a* for attaching a charge toner having a predetermined polarity to the electrostatic latent image and forming a toner image, a transfer member 14 such as a contact transfer roller for applying a transfer voltage to the transfer member 16 that is paper-fed and carried by a paper-feeding and carrying means 13 and thereby transferring the toner image to the transfer member 16, and a means 15 (cleaning blade 15*a*) for cleaning the electrostatic image supporting material in order to collect the residual untransferred toner on the electrostatic image supporting material 10.

Upon formation of an image, the electrostatic image supporting material drum 10 is uniformly charged by the contact charging member 11, the surface of the electrostatic image supporting material drum 10 is irradiated with a laser beam and so forth from the exposure device and thereby, the electrostatic latent image is formed. That is, the electric potential in the part irradiated with a light is lowered and the electrostatic latent image is formed. The development device 12 has the rotatable development sleeve 12*a* that is disposed oppositely to the electrostatic image supporting material drum 10, and attaches the developing powder (toner) supported on the surface of the development sleeve 12*a* to the electrostatic latent image on the surface of the electrostatic image supporting material drum 10 and thereby develops (visualizes) the image as the toner image. That the developing powder in the development device 12 is stirred by an stirring member, and frictioned and charged to the same polarity as the charged polarity of the electrostatic image supporting material drum 10 and then, carried to the side of the development sleeve 12*a*. The development sleeve 12*a* is disposed so that a predetermined gap with respect to the electrostatic image supporting material drum 10 is provided, and the developing powder on the surface of the developing sleeve 12*a* is subjected to restriction of layer thickness by the restricting blade 12*b* and thereby, formed so as to have a predetermined layer thickness. Then, by applying a development bias to the development sleeve 12*a*, the charged toner adheres to the part in which the electric potential is lowered by the above-described image exposure and thereby, the toner image is formed on the surface of the electrostatic image supporting material drum 10. By the contact transfer roller 14, the transfer voltage is applied to the paper-fed and carried transfer member 16 and thereby, the toner image on the electrostatic image supporting material drum 10 is transferred to the transfer member 16. The residual toner on the electrostatic image supporting material 10 is removed and collected by the cleaning blade 15*a*.

As the material used for the development sleeve 12*a*, it is preferable a stainless steel (SUS) is used as the sleeve material in the case of considering high durability. For example, SUS303, SUS304, SUS305, SUS316, and so forth can be used. In particular, SUS 305, which has a weak magnetism and is easy to be processed, is more preferably used. Moreover, aluminum can also be used. However, in a low-speed electrographic process, durability can be maintained even in the case of a relatively soft material such as aluminum. However, in a high-speed process, the durability performance cannot be ensured. Accordingly, for satisfying the high-speed process, the stainless steel that is difficult to be damaged and to be trimmed is used and thereby, the high durability can be ensured.

In the present invention, the surface roughness Rz of the development sleeve using the stainless steel is from 3.0 to 5.7 μm, and preferably from 3.0 to 5.5 μm. If the surface roughness is more than 5.7 μm, the thickness of the toner thin layer becomes too thick to obtain a stable layer. On the other hand, if the surface roughness is less than 3.0 μm, the toner carrying force is week and, there is a fear that the thickness of the toner thin layer becomes thin and the image concentration is degraded. The surface roughness can be measured by, for example, using the surface roughness-measuring equipment "Surf coder SE-30D" manufactured by Kosaka Laboratory Ltd., based on JIS B 0601-2001. The surface roughness can be controlled by a sandblast method or a bead-blast method or the like.

In addition, the image forming method according to the present invention is not limited to the jumping development system of magnetic one-component, and also can be suitably used, for example, for a so-called hybrid development system. This system has, a donor roller that is opposed to the electrostatic image supporting material and supports the toner, and a toner carrying roller that is opposed to the donor roller and supports a two-component developing powder containing toner and magnetic carrier. A large amount of the developing powder is supplied from the toner-carrying roller by a magnetic blush and thereby, a toner thin layer is formed on the donor roller.

EXAMPLES

The following examples illustrate the manner in which the present invention can be practiced. It is understood, however, that the examples are for the purpose of illustration and the invention is not to be regarded as limited to any of the specific materials or condition therein.

Hereinafter, in Examples, the present invention will be explained with reference to examples using magnetic one-component toner. However, of course, two-component one can also used with no problem.

Example 1

In the composition as shown in Table 1, through the steps as shown in Table 2, Turbo Mill T-250 type (manufactured by TURBO KOGYO CO., LTD.) was used and the grinding step was performed at one time at an airflow of 10 $Nm^3$/min and at a rotational frequency of 8,500 rpm and thereby, the toner particles were obtained. The volume average particle size of the toner particles was 7.2 μm. 0.8 parts by mass of Silica (RA-200H, manufactured by NIPPON AEROSIL Co., Ltd.) based on 100 parts by weights of the toner particles was added to the obtained toner particles, and then agitation was performed for three minutes in Henschel mixer and thereby, silica was made to adhere to surfaces of the toner particles and the toner of the present invention was prepared. Then, as shown in Table 3, the case in which the obtained toner and the development sleeve having the surface roughness Rz of 4.3 μm were used was set to Example 1.

TABLE 1

| | Material | Manufacturer | No. of product | Amount (Parts by mass) |
|---|---|---|---|---|
| Binder resin | Styrene-acryl resin | Sanyo Chemical Industries, Ltd. | — | 100 |
| Magnetic Powder | Magnetic Powder | TODA KOGYO CORP. | EPT-1000 | 70 |
| Charge control agent | Nigrosin dye | Orient Chemical Industries, Ltd. | N-O1 | 5 |
| Wax | Poly-propylene | Sanyo Chemical Industries, Ltd. | UMEX100TS | 3 |
| External addition agent | Silica | Wacker-Chemie GmbH | H2050EP | 0.8[1)] |

[1)]Mass % to total mass of toner.

TABLE 2

| Steps | Apparatus (Manufacturer) | Conditions |
|---|---|---|
| 1) Mixing | Henschel mixer 20B (MITSUI MINING CO. LTD.) | 2500 rpm × 5 min |
| 2) Kneading | Twin screw extruder PCM-30T (IKEGAI LTD.) | Rotational frequency 200 rpm, Temperature of Cylinder 120° C., Input Amount 6 kg/h |

TABLE 2-continued

| Steps | Apparatus (Manufacturer) | Conditions |
|---|---|---|
| 3) Cooling | Drum flaker (MITSUI MINING CO. LTD.) | 140 mm/sec, Adjusting of Plate Thickness to 3~4 mm |
| 4) Grinding | Turbo Mill T-250 type (TURBO KOGYO CO., LTD.) | — |
| 5) Classification | Alpine classification apparatus | — |
| 6) Surface treating | Henschel mixer 20B (MITSUI MINING CO. LTD.) | 2500 rpm × 3 min |

Example 2

The toner was produced in the same manner as in Example 1, except for setting the rotational frequency of Turbo Mill to 10,500 rpm. Then, the case in which the toner and the development sleeve having the surface roughness Rz of 3.0 μm were used was set to Example 2.

Example 3

The toner was produced in the same manner as in Example 1, except for setting the rotational frequency of Turbo Mill to 7,500 rpm. Then, the case in which the toner and the development sleeve having the surface roughness Rz of 5.5 μm were used was set to Example 3.

Comparative Example 1

The case in the same manner as in Example 1, except for setting the rotational frequency of Turbo Mill to 11,500 rpm was set to Comparative Example 1.

Comparative Example 2

The case in the same manner as in Example 1, except for setting the rotational frequency of Turbo Mill to 6,500 rpm was set to Comparative Example 2.

Comparative Example 3

The case in the same manner as in Example 1, except for setting the rotational frequency of Turbo Mill to 8,500 rpm and for classifying under the same conditions as in comparative example 1 and 2 in the classification step was set to Comparative Example 3.

Comparative Example 4

The case in the same manner as in Example 1, except for setting the rotational frequency of Turbo Mill to 7,500 rpm and for controlling by inputting more input amount in the classification step than that of comparative example 3 in the classification step was set to Comparative Example 4.

Comparative Example 5

The case in the same manner as in Example 1, except for setting the surface roughness Rz of the development sleeve to 5.8 μm was set to Comparative Example 5.

Comparative Example 6

The case in the same manner as in Example 1, except for setting the surface roughness Rz of the development sleeve to 2.6 μm was set to Comparative Example 6.

Comparative Example 7

The case in the same manner as in Example 1, except for setting the airflow amount of Turbo Mill to 7.5 $Nm^3$/min and for setting the rotational frequency to 8,500 rpm was set to Comparative Example 7.

Comparative Example 8

The case in the same manner as in Example 1, except for setting the airflow amount of Turbo Mill to 12.5 $Nm^3$/min and for setting the rotational frequency to 8,500 rpm was set to Comparative Example 8.

Comparative Example 9

The case in the same manner as in Example 1, except for setting the airflow amount of Turbo Mill to 7.5 $Nm^3$/min and for setting the rotational frequency to 9,500 rpm was set to Comparative Example 9.

Comparative Example 10

The case in the same manner as in Example 1, except for setting the airflow amount of Turbo Mill to 12.5 $Nm^3$/min and for setting the rotational frequency to 7,500 rpm was set to Comparative Example 10.

(Measurement of Particle Size)

The volume average particle size of the toner particles means a particle size ($D_{50v}$) when the volume accumulated from its small diameter side becomes 50%, and was measured by Multisizer TA-II that was a coulter counter manufactured by Beckman coulter Inc.).

(Measurement of Shape Coefficients)

The shape coefficients of the toner were obtained as follows. 100 images of the toner particles having 10 μm or less, which were magnified at 1000 times by using FE-SEM (S-800) manufactured by Hitachi, Ltd., were randomly sampled, and through an interface, the image information was introduced and analyzed in the image-analyzing apparatus (Lezex III) manufactured by Nicolet Inc. and calculated by the above-described formulas (1) and (2). Thereby the coefficients were obtained.

(Measurement of Toner Density)

Toner density was obtained as follows. An overlaid image was developed on the photoreceptor drum, and by using a sucking apparatus to which a nozzle and such are attached, the overlaid image on the photoreceptor drum was sucked and its weight was measured. Then, the weight was divided by the sucked area ($cm^2$) and the toner density ($mg/cm^2$) was calculated.

(Examination for Evaluation and Method for Evacuation)

By using the toners according to Examples 1 to 3, and Comparative Examples 1 to 10, the printers (KM-3530) manufactured by KYOCERA MITA Corp. on which a positively charged a-Si photoconductor drum was mounted/a development sleeve made of SUS was mounted. Evaluation examination of image characteristics was performed in an initial stage. Therewith, the state of the used toner amount was investigated.

The evaluation result was shown in Table 3.

As the image characteristics, the image density (ID), the fog (FD), and the dot reproducibility were evaluated. The evaluation method and the evaluation criteria were as follows.

For the image density (ID), an image evaluation pattern was printed out by the printer in the initial stage under an environment of a normal temperature and a normal humidity (20° C. and 65% RH), and thereby the pattern was made to be an initial image, and its solid image was measured by using Macbeth reflection densitometer (RD914). The densities were measured at 9 points in a certain overlaid part and thereby, their average (ID) was calculated. The evaluation criterion that the image density of 1.28 or more was accepted was determined.

The fog density (FD) was measured by using the reflection densitometer (TC-6D, manufactured by Tokyo Denshoku Co., Ltd.). The evaluation criterion that the fog density (FD) of 0.008 or less was accepted was determined.

The dot reproducibility was confirmed visually using a loupe. The evaluation criteria were as follows.

◎: Favorable reproducibility without crack or collapse.

O: Almost reproduced although inferior to ◎.

Δ: Crack or collapse can be observed.

X: Crack or collapse exists.

TABLE 3

| | Average particle size of toner (μm) | Particle size of toner under 5 μm (Vol %) | Development sleeve Rz (μm) | Shape coefficient of toner SF-1 | Shape coefficient of toner SF-2 | Toner density (mg/cm$^2$) |
|---|---|---|---|---|---|---|
| Example 1 | 7.2 | 6.2 | 4.3 | 128 | 133 | 0.72 |
| Example 2 | 6.2 | 10.0 | 3.0 | 115 | 115 | 0.82 |
| Example 3 | 7.8 | 2.5 | 5.5 | 150 | 145 | 0.62 |
| Comparative Example 1 | 5.7 | 6.4 | 4.3 | 125 | 137 | 0.83 |
| Comparative Example 2 | 8.2 | 6.0 | 4.3 | 122 | 138 | 0.60 |
| Comparative Example 3 | 7.2 | 2.1 | 4.3 | 123 | 130 | 0.61 |
| Comparative Example 4 | 7.3 | 11.2 | 4.3 | 130 | 133 | 0.79 |
| Comparative Example 5 | 7.2 | 6.2 | 5.8 | 128 | 133 | 1.02 |
| Comparative Example 6 | 7.2 | 6.2 | 2.6 | 128 | 133 | 0.52 |
| Comparative Example 7 | 7.2 | 5.8 | 4.3 | 114 | 139 | 0.95 |
| Comparative Example 8 | 7.1 | 6.8 | 4.3 | 157 | 129 | 0.58 |
| Comparative Example 9 | 7.2 | 5.9 | 4.3 | 127 | 110 | 0.91 |
| Comparative Example 10 | 7.4 | 5.8 | 4.3 | 131 | 152 | 0.60 |

| | Initial ID | Initial FD | Dot reproducibility | Used toner amount (mg/cm$^2$) |
|---|---|---|---|---|
| Example 1 | 1.326 | 0.005 | ○ | 0.801 |
| Example 2 | 1.366 | 0.008 | ◎ | 0.886 |
| Example 3 | 1.318 | 0.003 | ○ | 0.738 |
| Comparative Example 1 | 1.371 | 0.009 | Δ | 0.921 |
| Comparative Example 2 | 1.269 | 0.006 | Δ | 0.689 |
| Comparative Example 3 | 1.278 | 0.005 | ○ | 0.711 |
| Comparative Example 4 | 1.357 | 0.011 | ○ | 0.942 |
| Comparative Example 5 | 1.376 | 0.012 | x | 1.121 |
| Comparative Example 6 | 1.262 | 0.003 | ○ | 0.613 |
| Comparative Example 7 | 1.377 | 0.009 | x | 1.070 |
| Comparative Example 8 | 1.256 | 0.006 | ○ | 0.634 |
| Comparative Example 9 | 1.365 | 0.010 | x | 0.998 |
| Comparative Example 10 | 1.275 | 0.005 | ○ | 0.655 |

As shown in Table 3, in Comparative Example 1, fog was caused because the average particle size of the toner was smaller than that of the range of the present invention, and in Comparative Example 2, the image concentration was lowered because the average particle size of the toner was smaller than that of the range of the present invention. In Comparative Example 3, the image concentration was lowered because the content of dust-size particles in the toner was smaller than that of the range of the present invention, and in Comparative Example 4, because the content of dust-size particles in the toner was larger than that of the range of the present invention, fog was caused. In Comparative Example 5, the toner density was enhanced because the surface roughness of the development sleeve was larger than that in the range of the present invention, and however, fog was caused, and dot reproducibility was degraded. In Comparative Example 6, the toner density becomes small and the lowering of the image concentration was observed because the surface roughness of the development sleeve was smaller than that of the range of the present invention. In Comparative Example 7, fog was caused and the dot reproducibility was degraded because the shape coefficient SF-1 was smaller than the range of the present invention. In Comparative Example 8, the lowering of the image concentration was observed because the shape coefficient SF-1 was larger than the range of the present invention. In Comparative Example 9, fog was caused and the dot reproducibility was degraded because the shape coefficient SF-2 was smaller than the range of the present invention. In Comparative Example 10, the lowering of the image concentration was observed because the shape coefficient SF-2 was larger than the range of the present invention.

On the other hand, in every one of Examples 1 to 3 set in the range of the present invention, the image concentration and fog were favorable, and also the used toner amount was small, and the toner image having a high toner density could be obtained, and it was confirmed that a sufficient image concentration was ensured even when the used toner amount was small, and also reproducibility of the dot image high.

It is further understood by those skilled in the art that the foregoing description is a preferred embodiment of the disclosed image forming apparatus and that various changes and modifications may be made in the invention with out departing from the spirit and scope thereof. In description, "% by mass" or "mass %" may be replaced with "% by weight".

What is claimed is:

1. An image forming method containing a development step of developing an electrostatic latent image formed on an electrostatic image supporting material, using a toner formed on a development sleeve in the form of a thin layer to form a toner image, wherein a ten-point average roughness Rz on the surface of the development sleeve is from 3.0 to 5.7 pm, a volume average particle size of toner particles is from 6.0 to 8.0 pm, the content of the toner particles having a volume average particle size of 5.0 pm or less is from 2.2 to 11.0% by volume, a shape coefficient SF-1 of the toner particles that is measured by an image-analyzing apparatus and represented by a following formula (1) satisfies the relation: 115≦SF-1≦155, and a shape coefficient SF-2 of the toner particles that is measured by an image-analyzing apparatus and represented by a following formula (2) satisfies the relation: 112≦SF-2≦150:

$$SF\text{-}1=\{(MXLNG)^2/\mathrm{AREA}\}(\pi/4)100 \quad (1)$$

$$SF\text{-}2=\{(\mathrm{PERI})^2/\mathrm{AREA}\}(1/4\pi)100 \quad (2)$$

where MXLNG denotes an absolute maximum length of the particle, PERI denotes a peripheral length of the particle, and AREA denotes a projected area of the particle.

2. The image forming method according to claim 1, wherein a toner density of the toner thin layer formed on the surface of the development sleeve is from 0.62 to 0.82 $mg/cm^2$.

3. The image forming method according to claim 1, wherein the development sleeve is made of SUS (stainless steel).

4. The image forming method according to claim 1, wherein a jumping development system of magnetic one-component is used.

5. The image forming method according to claim 1, comprising a charge step of charging the surface of the electrostatic image supporting material, an exposure step of exposing the charged surface of the electrostatic image supporting material to form an electrostatic latent image, a development step of forming a toner image on the electrostatic latent image, and a transfer step of transferring the toner image formed on the electrostatic image supporting material, into a transfer member.

6. An image forming apparatus comprising charge device for charging the surface of an electrostatic image supporting material, exposure device for exposing the charged surface of an electrostatic image supporting material to form an electrostatic latent image, development device for developing the electrostatic latent image by a toner formed with a thin layer on a development sleeve to form a toner image on the electrostatic latent image, and transfer device for transferring the toner image formed onto the electrostatic image supporting material, into a transfer member, wherein a ten-point average roughness Rz on the surface of the development sleeve is from 3.0 to 5.7 pm, and a volume average particle size of toner particles is from 6.0 to 8.0 pm, the content of a volume average particle size of the toner particles of 5.0 pm or less is from 2.2 to 11.0% by volume, a shape coefficient SF-1 of the toner particles that is measured by an image-analyzing apparatus and represented by a following formula (1) satisfies the relation: 115≦SF-1≦155, and a shape coefficient SF-2 of the toner particles that is measured by an image-analyzing apparatus and represented by a following formula (2) satisfies the relation: 112≦SF-2≦150:

$$SF\text{-}1=\{(MXLNG)^2/\mathrm{AREA}\}(\pi/4)100 \quad (1)$$

$$SF\text{-}2=\{(\mathrm{PERI})^2/\mathrm{AREA}\}(1/4\pi)100 \quad (2)$$

where MXLNG denotes an absolute maximum length of the particle, PERI denotes a peripheral length of the particle, and AREA denotes a projected area of the particle.

7. The image forming method according to claim 2, wherein the development sleeve is made of SUS (stainless steel).

* * * * *